United States Patent [19]

Green

[11] 4,262,826

[45] Apr. 21, 1981

[54] AUXILIARY BUNGHOLE ATTACHMENT

[76] Inventor: Eddie P. Green, Portland, Oreg.

[21] Appl. No.: 107,843

[22] Filed: Dec. 28, 1979

Related U.S. Application Data

[63] Continuation of Ser. No. 917,632, Jun. 21, 1978, abandoned.

[51] Int. Cl.[3] ..... B65D 25/48

[52] U.S. Cl. ..... 222/567

[58] Field of Search ..... 222/567, 570, 573; 217/109, 114, 108; 220/85 F, 86 R, 85 SP, DIG. 1

[56] References Cited

U.S. PATENT DOCUMENTS 2,261,834 11/1941 Morgan ..... 222/567

*Primary Examiner*—Stanley H. Tollberg

*Attorney, Agent, or Firm*—Klarquist, Sparkman, Campbell, Leigh, Hall & Whinston

[57] ABSTRACT

An attachment for a barrel includes a plate and a fastening mechanism having a locking arm and lever for releasably securing the plate to the rim of a barrel. When secured in position, an auxiliary bunghole through the plate is aligned with the bunghole of the barrel. A threaded pump mounting projects outwardly from the plate and away from the barrel. A seal prevents leakage of liquid from the barrel between the plate and barrel bunghole.

12 Claims, 4 Drawing Figures

AUXILIARY BUNGHOLE ATTACHMENT

This is a continuation of application Ser. No. 917,632, filed June 21, 1978 now abandoned.

BACKGROUND OF THE INVENTION

1. Field of the Invention

The present invention relates to an attachment for providing an auxiliary bunghole for a barrel.

2. Description of the Prior Art

Presently, hand pumps are threadably connected directly to the bunghole of a barrel. However, during pumping, stresses are applied to the barrel bunghole. As a result, cracks and other fatigue failures occur in the bunghole and adjacent portion of the barrel. Because new barrels are costly and hard to obtain, when a bunghole is damaged the barrels are repaired rather than discarded. This is expensive and time consuming. Furthermore, spare barrels must be kept in inventory for use when a damaged barrel is being repaired.

Therefore, a need exists for a device for relieving the stresses applied to the bunghole of a barrel during pumping. More specifically, a need exists for an auxiliary bunghole attachment which provides an alternate mounting means for a pump to relieve pumping stresses applied to the barrel bunghole.

SUMMARY OF THE INVENTION

It is a primary object of the invention to provide a device for protecting barrel bungholes from damage resulting from stresses applied thereto by hand pumps when liquid is pumped from the barrel.

It is another object of the invention to provide an auxiliary bunghole attachment which may be rigidly attached to a barrel so as to provide a stable support for a hand pump.

It is still a further object of the invention to provide an auxiliary bunghole attachment which may be releasably secured to a barrel so that it can be easily transferred from a first barrel to another when the first barrel becomes empty.

A further object of the invention is to provide an auxiliary bunghole attachment which is adapted to seal the barrel when mounted to prevent leakage of fluid from the barrel and to prevent contaminates from entering the barrel.

A further object of the invention is to provide an auxiliary bunghole attachment which is adapted to facilitate the transfer of the attachment from one barrel to another without requiring the removal of a pump which has been mounted to the attachment.

Another object of the invention is to provide an auxiliary bunghole attachment which is of simple yet strong construction, which requires little maintenance, and which is easy to use.

The foregoing and other objects, features and advantages of the present invention will become more apparent from the following detailed description which proceeds with reference to the accompanying drawing.

DESCRIPTION OF THE PREFERRED EMBODIMENT

Figure 1:
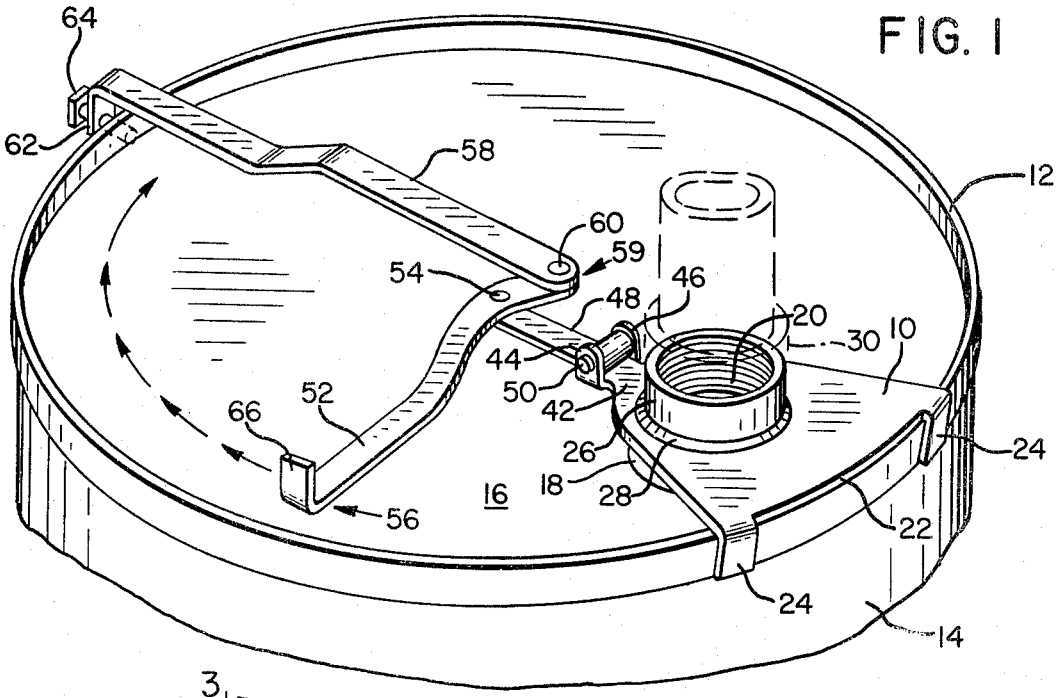
FIG. 1 is a perspective view of an auxiliary bunghole attachment in accordance with the present invention.
Figure 2:
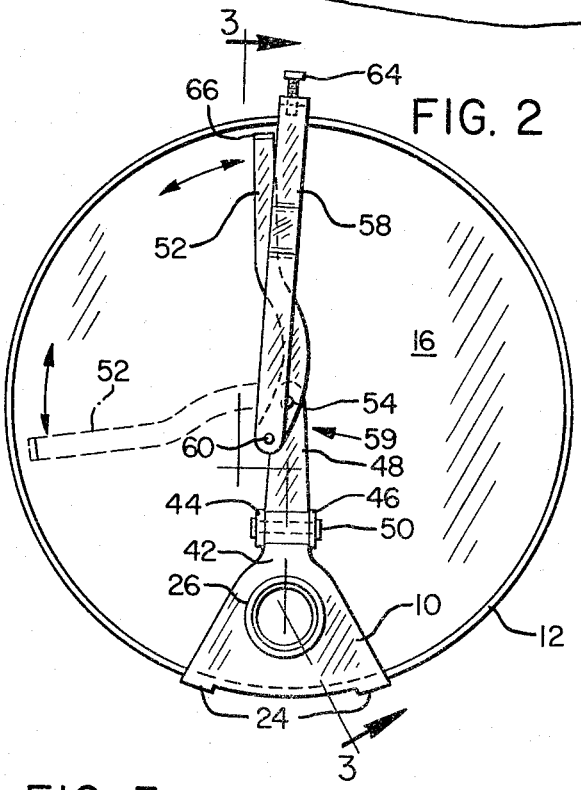
FIG. 2 is a top plan view of the attachment of FIG. 1.
Figure 4:
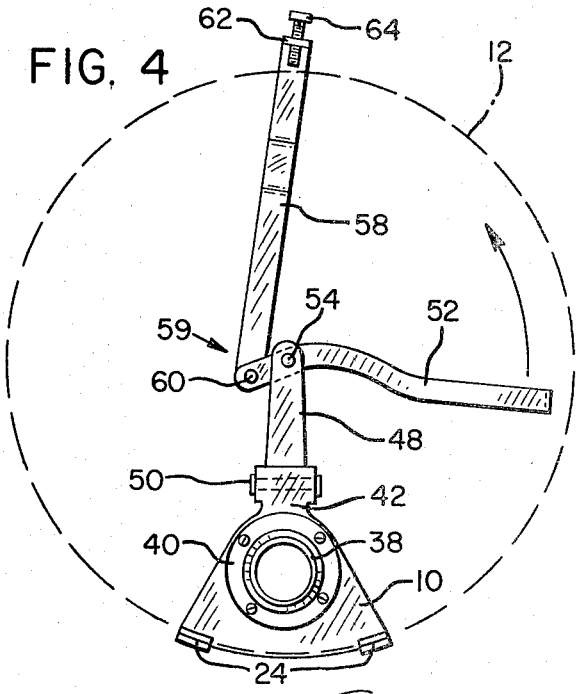
FIG. 4 is a bottom view of the attachment of FIG. 1.
Figure 3:
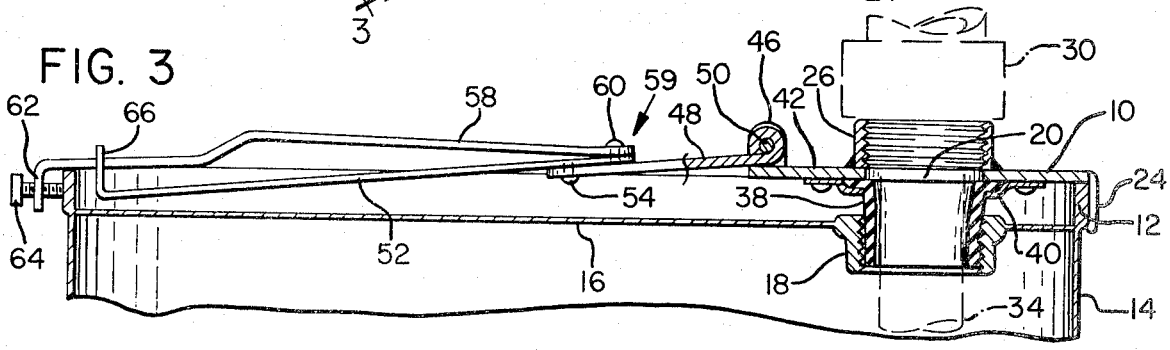
FIG. 3 is a cross-sectional view of the attachment taken along line 3—3 of FIG. 2.

With reference to FIGS. 1 and 3, a barrel is shown having a pair of ends, one indicated at 16, which are joined together by a sidewall portion 14 extending therebetween. Typically, sidewall portion 14 has a rim 12 where it joins end 16. An auxiliary bunghole attachment is provided with an auxiliary bunghole support member which defines an auxiliary bunghole for positioning in alignment with a bunghole 18 of the barrel. Bunghole 18 in turn communicates through end 16 with the interior of the barrel. The bunghole support member is fastened to the outside or exterior of the barrel at positions spaced from bunghole 18 and, in the preferred form, is adapted for mounting to the exterior surface of sidewall 14 of the barrel. In the illustrated preferred embodiment, the bunghole support member includes a plate 10, preferably of steel, adapted for mounting to rim 12 of the barrel.

Plate 10 has a circular auxiliary bunghole 20 through it which is aligned with bunghole 18, as shown in FIG. 3, when plate 10 is mounted. The outer peripheral edge 22 of plate 10 is curved to generally follow the contour of the perimeter of the barrel. A pair of ears 24 project downwardly from the peripheral edge 22 so as to overlap and engage rim 12 to prevent the plate from sliding radially inwardly toward the center of the barrel.

An internally threaded cylinder 26 is welded by a weld 28 to the upper surface of plate 10 with the bore of the cylinder aligned with auxiliary bunghole 20.

An externally threaded mounting portion 30 of a conventional hand pump can be screwed into cylinder 26 and hence rigidly secured to plate 10. A tube 34 of the pump extends downwardly into the liquid within the barrel to permit pumping thereof as desired.

An annular gasket 38, preferably of soft petroleum proof rubber, is secured to the lower surface of plate 10 by a gasket retaining ring 40 screwed to the plate. Gasket 38 prevents liquid inside the barrel from splashing out between plate 10 and bunghole 18. In addition, the gasket prevents contaminants from entering the barrel at this location.

Plate 10 narrows radially inwardly with its radial inwardmost portion 42 having a pair of parallel spaced apart upwardly projecting flanges 44,46 mounted thereto. A bar 48 has one end pivoted between flanges 44, 46 by a pivot pin 50 for movement about an axis parallel to end 16.

A lever 52 is pivoted to the other end of arm 48 by a pivot pin 54 which is perpendicular to end 16 of the barrel and which is located intermediate the respective ends 56, 59 of the lever. A locking arm 58 is pivoted at one end by a pin 60 to the upper surface of end 59 of lever 52. Pin 60 is parallel to and spaced from pin 54. The other end of locking arm 58 is bent downwardly to provide an ear 62 which overlaps rim 12 at a location generally opposite the portion of the rim engaged by ears 24. An internally threaded hole through ear 62 receives a bolt 64 and provides a means for adjusting the attachment to fit barrels of varying sizes. That is, to fit small diameters the bolt is screwed inwardly toward the barrel. In contrast, for barrels of larger diameters the bolt is screwed outwardly. In addition, the radially inward end of locking arm 58 is bent upwardly relative to its outer end while the outer section of lever 52 curves away from locking arm 58. In addition, the outermost tip of lever 52 is bent upwardly to provide a stop 66.

OPERATION

The ears 24 are hooked over a portion of rim 12 so that the auxiliary bunghole 20 is aligned with bunghole 18. Lever 52 is moved away from locking arm 58 so that ear 62 can be hooked over a portion of the rim which is generally across the barrel from the portion engaged by ears 24. Bolt 64 may be adjusted so that the locking arm is of a proper length for the barrel. Thereupon, as shown in FIG. 3, lever 52 is moved toward arm 58 thereby urging ears 24 and 62 into tighter engagement with rim 12. Eventually, the limit stop 66 contacts the side of arm 58 preventing additional movement of lever 52 in this direction. Furthermore, the inner portion of lever 52 slides underneath the raised portion of arm 58 so that lever 52 is locked in position over dead center.

Consequently, ears 24, 62 grip rim 12 securely so that the attachment provides a stable mount for the pump. Therefore, during pumping, stress is exerted on the attachment and is relieved from bunghole 18. Because the attachment is stronger than the bunghole, it can more effectively withstand these stresses without damage.

To remove the attachment, such as when the barrel is empty, lever 52 is pivoted away from locking arm 58 until arm 58 can be lifted away from rim 12. Lever 52, locking arm 58 and bar 48 can then be pivoted away from end 16 of the barrel about the axis of pin 50. This enables the attachment, with the mounted pump, to be lifted upwardly away from the barrel and transferred to another barrel. Thus, it is unnecessary to remove the pump prior to switching the attachment to another barrel. Consequently, little time and effort is required to switch barrels.

Having illustrated and described the principals of my invention with reference to one preferred embodiment, it should be apparent to those persons skilled in the art that such invention may be modified in arrangement and detail without departing from such principals. I claim as my invention all such modifications as come within the true spirit and scope of the following claims.

I claim:

1. An apparatus for protecting the bunghole of a barrel comprising:

an auxiliary bunghole attachment adapted for rigid connection to the rim of a barrel with an auxiliary bunghole positioned in alignment with the bunghole of the barrel so as to permit the insertion of a portion of a pump through the hole and bunghole and into the barrel, said apparatus including lever actuated fastening means for releasably connecting said auxiliary bunghole attachment to the rim of the barrel said lever actuated fastening means including a lever with a pivot fulcrum inwardly of the rim of the barrel.

2. An apparatus for protecting the bunghole of a barrel comprising:

an auxiliary bunghole attachment including auxiliary bunghole attachment fastening means for rigidly connecting said attachment to the outside of the barrel at positions spaced from the bunghole of the barrel, said attachment also including a rigid auxiliary bunghole defining member spaced from the barrel bunghole defining portion of the barrel and defining an auxiliary bunghole spaced from the bunghole of the barrel;

pump mounting means for rigidly and releasably mounting a pump to said auxiliary bunghole defining member such that said pump is releasable from said auxiliary bunghole defining member without disconnecting said auxiliary bunghole attachment from the barrel; and the pump being inserted into the barrel through the auxiliary bunghole and barrel bunghole;

semi-rigid sealing means for providing a sealed passageway communicating between said auxiliary bunghole and the bunghole of the barrel, said sealing means slidably engaging the barrel bunghole defining portion of the barrel to seal the passageway at the barrel bunghole, said sealing means being connected to said auxiliary bunghole defining member independently of said pump mounting means such that the pump is releasable from the auxiliary bunghole attachment without disconnecting said sealing means from said auxiliary bunghole defining member.

3. An apparatus for protecting the bunghole of a barrel comprising:

an auxiliary bunghole attachment adapted for rigid connection to the rim of the barrel at positions spaced from the bunghole of the barrel and with an auxiliary bunghole positioned in alignment with the bunghole of the barrel so as to permit the insertion of a portion of a pump through the hole and bunghole and into the barrel; and said attachment including a plate and pump mounting projecting outwardly in one direction from one surface of said plate and away from the barrel, the pump mounting defining an internally threaded bore which is aligned with said auxiliary bunghole, whereby an externally threaded cylindrical mounting portion of the pump can be threaded into said bore to secure the pump to the cylinder and thereby mount the pump to the plate;

said attachment also including at least two rim engaging members projecting from said plate in a direction opposite said one direction, said rim engaging members being a fixed distance from the center of said auxiliary bunghole such that when said rim engaging members engage the rim of the barrel, the center of said auxiliary bunghole is automatically positioned a distance from the rim of the barrel which is equal to the distance from the rim to the center of the barrel bunghole, thereby facilitating alignment of the auxiliary bunghole and barrel bunghole.

4. An apparatus according to claim 3 including fastening means for releasably engaging the rim of the barrel at a location generally opposite to said rim engaging members to releasably connect said attachment rigidly to the rim of the barrel.

5. An apparatus for protecting the bunghole of a barrel comprising:

an auxiliary bunghole attachment adapted for rigid connection to the outside of a barrel, said attachment including an auxiliary bunghole support member positioned to define an auxiliary bunghole in alignment with the bunghole of the barrel so as to permit the insertion of a portion of a pump through the auxiliary bunghole and bunghole and into the barrel;

fastening means for connecting said support member to the outside of the barrel at positions spaced apart from the bunghole of the barrel;

said fastening means comprising means for releasably connecting said support member rigidly to the sidewall of the barrel;

said support member comprising a plate and said fastening means comprising means for releasably connecting said plate rigidly to the sidewall of the barrel, said fastening means including a barrel engaging portion extending from one side of said plate for engaging a portion of the sidewall of the barrel at one side of the barrel, said fastening means also including a connecting portion which extends from said plate in a direction generally away from said one side of the barrel, a lever arm pivoted to the free end of said connecting portion at a location intermediate the ends of said lever arm for pivoting about a first axis generally perpendicular to the surface of the barrel having the bunghole, and a locking arm pivoted at one end to one end of said lever arm for pivoting about a second axis parallel to and spaced from said first axis, the other end of said locking arm being adapted for operatively engaging a portion of the sidewall of the barrel at a side generally opposite to said one side, whereby pivoting said lever toward said locking arm causes said locking arm and plate to grip the sidewall of the barrel.

6. An apparatus according to claim 5 whereby said locking arm includes adjustment means for adjusting the length thereof for gripping the rim of barrels of varying dimensions.

7. An auxiliary bunghole attachment for an upright barrel having a bunghole through its upper end comprising:

a plate adapted for rigid attachment to the cylindrical rim of a barrel with an auxiliary bunghole through the plate positioned in alignment with the bunghole of the barrel, said plate having a plurality of downwardly projecting ears for engaging the rim at one side of the barrel;

a pump mounting projecting outwardly from the upper surface of said plate and away from the barrel, said pump mounting defining an internally threaded bore which is aligned with the auxiliary bunghole, whereby said pump mounting is adapted to receive an externally threaded portion of a pump to thereby secure the pump to said plate with a tube from the pump extending into the barrel through the bore, auxiliary bunghole and barrel bunghole;

an annular gasket secured to the lower surface of said plate with the opening through said gasket aligned with said auxiliary bunghole, said gasket being adapted for insertion into the barrel bunghole to prevent leakage of liquid from the barrel between the auxiliary bunghole and barrel bunghole;

fastening means for releasably securing said plate to said barrel, said fastening means including a connecting portion extending outwardly from a portion of said plate which is radially inward from the portion of the rim engaged by said ears, a lever arm pivoted intermediate its end to the free end of said connecting portion for pivoting about a first vertical axis, a locking arm pivoted at one end to one end of said lever arm for pivoting about a second vertical axis parallel to and spaced apart from said first vertical axis, the other end of said locking arm being adapted for engaging the rim of the barrel at a location generally across from the portion of the barrel engaged by said ears, whereby pivoting said lever arm toward said locking arm causes said locking arm and plate to grip the barrel rim securely.

8. An attachment according to claim 7 in which said connecting portion is pivoted to said plate for pivoting about a third axis which is generally perpendicular to said first and second axes, whereby when said locking arm is disengaged from the rim said fastening means may be pivoted upwardly away from the upper end of the barrel to facilitate lifting of the attachment together with a pump mounted thereto upwardly away from the barrel.

9. An attachment according to claim 8 whereby said lever arm includes an upwardly projecting stop at the end opposite said one end for engaging said locking arm during pivoting of said lever arm to thereby limit the pivoting of said lever arm.

10. An apparatus according to claim 9 in which said locking arm is bent upwardly at its end adjacent to said connecting portion and in which the outer end of said lever is curved away from said locking arm, said locking arm and lever being positioned so as to provide a locking of said lever over dead center with a portion of said lever positioned underneath a portion of the upwardly bent portion of said locking arm when said stop engages said locking arm.

11. An apparatus according to claim 5 or 6 in which said barrel engaging portion is adapted to engage the rim of the barrel at one side of the barrel and said locking arm is adapted for engaging the rim to the barrel at a side generally opposite to said one side, whereby pivoting said lever toward said locking arm causes said locking arm and plate to grip the barrel rim.

12. An apparatus for protecting the bunghole of a barrel comprising:

an auxiliary bunghole attachment adapted for rigid connection to the outside of a barrel, said attachment including an auxiliary bunghole support member positioned to define an auxiliary bunghole in alignment with the bunghole of the barrel so as to permit the insertion of a portion of a pump through the hole and auxiliary bunghole and bunghole and into the barrel;

fastening means for connecting said support member to the outside of the barrel at positions spaced apart from the bunghole of the barrel; and one side of said support member having a portion which engages a portion of the rim at one side of the barrel, said fastening means including a connecting portion which extends from said support member in a direction generally away from said one side of the barrel, a lever arm pivoted to the free end of said connecting portion at a location intermediate the ends of said lever arm for pivoting about a first axis generally perpendicular to the surface of the barrel having the bunghole, a locking arm pivoted at one end to one end of said lever arm for pivoting about a second axis parallel to and spaced from said first axis, the other end of said locking arm being adapted for operatively engaging the rim of the barrel at a side generally opposite to said one side, whereby pivoting said lever toward said locking arm causes said locking arm and plate to grip the barrel rim.

* * * * *